US008132633B2

(12) United States Patent
Cuillier De Maindreville et al.

(10) Patent No.: US 8,132,633 B2
(45) Date of Patent: Mar. 13, 2012

(54) SELF POSITIONING CUTTER AND POCKET

(75) Inventors: Bruno Cuillier De Maindreville, Pau (FR); Gilles Gallego, Ibos (FR); Anthony Salliou, Pau (FR)

(73) Assignee: Varel International Ind., L.P., Carrollton, TX (US)

( * ) Notice: Subject to any disclaimer, the term of this patent is extended or adjusted under 35 U.S.C. 154(b) by 284 days.

(21) Appl. No.: 12/472,003

(22) Filed: May 26, 2009

(65) Prior Publication Data

US 2010/0258355 A1 Oct. 14, 2010

Related U.S. Application Data

(60) Provisional application No. 61/168,049, filed on Apr. 9, 2009.

(51) Int. Cl.
*E21B 10/62* (2006.01)
*E21B 10/627* (2006.01)

(52) U.S. Cl. ..... 175/431; 175/383; 175/384; 175/432

(58) Field of Classification Search ..... 175/432, 175/431
See application file for complete search history.

(56) References Cited

U.S. PATENT DOCUMENTS

| | | | | |
|---|---|---|---|---|
| 4,200,159 | A | 4/1980 | Peschel et al. | |
| 4,499,795 | A | 2/1985 | Radtke | |
| 4,529,048 | A * | 7/1985 | Hall | 175/432 |
| 4,654,947 | A * | 4/1987 | Davis | 29/402.08 |
| 4,844,185 | A * | 7/1989 | Newton et al. | 175/431 |
| 5,172,778 | A * | 12/1992 | Tibbitts et al. | 175/420.1 |
| 5,431,239 | A * | 7/1995 | Tibbitts et al. | 175/428 |
| 5,947,216 | A | 9/1999 | Truax et al. | |
| 6,302,224 | B1 | 10/2001 | Sherwood, Jr. | 175/397 |
| 7,025,155 | B1 * | 4/2006 | Estes | 175/413 |
| 7,070,011 | B2 | 7/2006 | Sherwood, Jr. et al. | 175/40 |
| 2002/0066600 | A1 | 6/2002 | Dvorachek | |
| 2007/0278017 | A1 * | 12/2007 | Shen et al. | 175/426 |
| 2009/0008155 | A1 | 1/2009 | Sherwood, Jr. | 175/431 |
| 2009/0020339 | A1 | 1/2009 | Sherwood, Jr. | 175/426 |

FOREIGN PATENT DOCUMENTS

| | | |
|---|---|---|
| WO | WO/2009/012432 | 1/2009 |

* cited by examiner

*Primary Examiner* — Giovanna Wright
(74) *Attorney, Agent, or Firm* — King & Spalding LLP

(57) ABSTRACT

A self positioning cutter element and cutter pocket for use in a downhole tool having one or more cutting elements. The self positioning cutter element includes a substrate and a wear resistant layer coupled to the substrate. The cutter element includes a cutting surface, a coupling surface, and a longitudinal side surface forming the circumferential perimeter of the cutter element and extending from the cutting surface to the coupling surface. The cutter element has one or more indexes formed on at least a portion of the coupling surface. In some embodiments, the index also is formed on at least a portion of the longitudinal side surface. Hence, the coupling surface is not substantially planar. Additionally, at least a portion of the longitudinal side surface does not form a substantially uniform perimeter. The cutter pocket also is indexed to correspond and couple with the indexing of the cutter element.

22 Claims, 4 Drawing Sheets

SELF POSITIONING CUTTER AND POCKET

CROSS-REFERENCE TO RELATED APPLICATIONS

This application claims the benefit of U.S. Provisional Patent Application No. 61/168,049, entitled "Self Positioning Cutter And Pocket," filed Apr. 9, 2009, the entirety of which is incorporated by reference herein.

TECHNICAL FIELD

The present invention relates generally to downhole tools used in subterranean drilling, and more particularly, to indexed cutting elements as well as indexed downhole tools configured for mounting the indexed cutting elements therein.

BACKGROUND OF THE INVENTION

Drill bits are commonly used for drilling bore holes or wells in earth formations. One type of drill bit is a fixed cutter drill bit which typically includes a plurality of cutting elements. The cutting elements have a disk shape, or in some instances, have a more elongated cylindrical shape. A cutting surface having a hard material, such as bound particles of polycrystalline diamond forming a diamond table, can be provided on a substantially circular end surface of a substrate of each cutting element. Typically, the polycrystalline diamond cutters ("PDC") are fabricated separately from the bit body and are secured within a cutter pocket formed within the bit body. A bonding material, such as an adhesive or a braze alloy, can be used to fix the cutting element to the bit body. The interface between the diamond table and the substrate is generally defined as a non-planar interface ("NPI"), which can require a specific orientation. This specific orientation is typically achieved using a mark on the substrate itself. Currently, the assembler visually orients the cutting element into the cutter pocket according to the markings seen on the substrate. This method is imprecise and does not guarantee a proper orientation of the cutting element. For example, some cutter elements having a non-planar diamond table face, a non-cylindrical diamond table face, or a specific geometry require precise orientation to efficiently cut earth formations.

There is a need in the art for an improved method to properly orient the cutter elements within the cutter pockets formed in downhole tools, such as a drill bit. There is a further need in the art to provide indexed cutter elements that allow for more precise cutter element orientation within a cutter pocket. Furthermore, there is a need to provide downhole tools having indexed cutter pockets that are capable of receiving the indexed cutter elements therein.

BRIEF DESCRIPTION OF THE DRAWINGS

The foregoing and other features and aspects of the invention may be best understood with reference to the following description of certain exemplary embodiments, when read in conjunction with the accompanying drawings, wherein.

Figure 1:
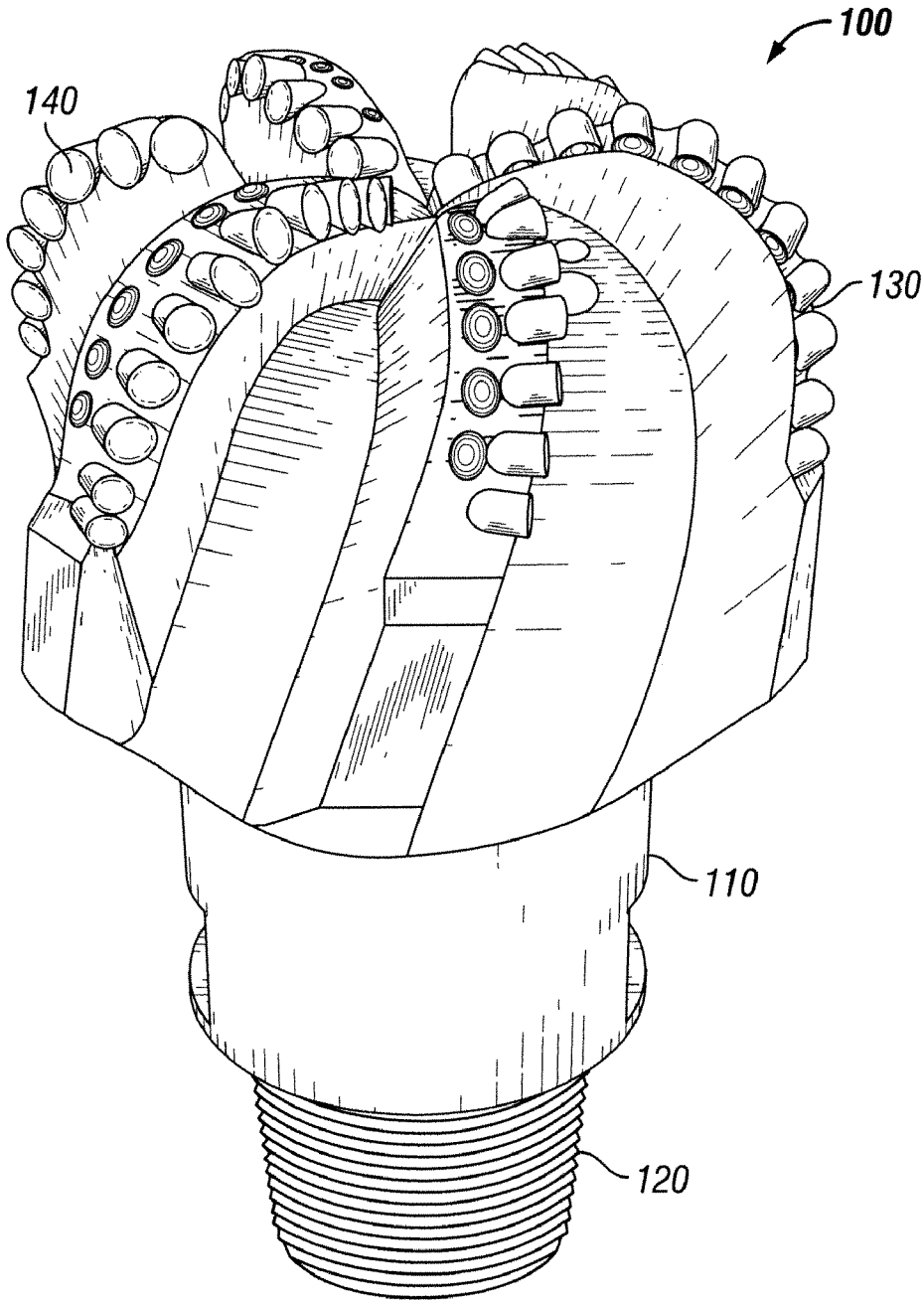
FIG. 1 shows a perspective view of a fixed cutter drill bit in accordance with an exemplary embodiment.

The drawings illustrate only exemplary embodiments of the invention and are therefore not to be considered limiting of its scope, as the invention may admit to other equally effective embodiments.

DETAILED DESCRIPTION OF INVENTION

The present invention is directed to downhole tools used in subterranean drilling. In particular, the application is directed to indexed cutting elements as well as indexed downhole tools configured for mounting the indexed cutting elements therein. Although the description of exemplary embodiments is provided below in conjunction with a fixed cutter drill bit, alternate embodiments of the invention may be applicable to other types of downhole tools having one or more cutter elements, including, but not limited to, PDC drill bits, core bits, eccentric bits, bi-center bits, hole openers, underreamers, and reamers.

The present invention may be better understood by reading the following description of non-limiting, exemplary embodiments with reference to the attached drawings, wherein like parts of each of the figures are identified by like reference characters, and which are briefly described as follows.

The present invention includes a method of forming one or more indexed cutter pockets in a downhole tool. The present invention also includes the use of a desired cutter pocket shape which is complementary to the shape of the cutter element's coupling surface. The present invention allows for one or more cutter elements to be oriented within the cutter pocket of the drill bit with a precision equal to the manufacturing tolerances used to make both parts.

FIG. 1 shows an oblique view of a fixed cutter drill bit 100 in accordance with an exemplary embodiment. The fixed cuter drill bit 100, or drill bit, includes a bit body 110 having a threaded connection at one end 120 and one or more blades 130 extending from the other end of the bit body 110. The blades 130 form the cutting portion of the drill bit 100. These blades 130 are coupled to the bit body 110 or, alternatively, the blades 130 are integrally formed into the bit body 110. One or more cutter elements 140 are coupled to each of the blades 130 and extend from the blades 130 to cut through earth formations when the drill bit 100 is rotated during drilling. Each cutter element 140 is inserted into a cutter pocket (not shown) and deform the earth formation by scraping and shearing.

The threaded connection is shown to be positioned on the exterior surface of the one end 120. This positioning assumes that the drill bit 100 is coupled to a threaded connection located on the interior surface of a drill string (not shown). However, the threaded connection can alternatively be positioned on the interior surface of the one end 120 if the threaded connection of the drill string (not shown) is positioned on the exterior surface, without departing from the scope and spirit of the exemplary embodiment. Although one type of connection is described, other types of connections known to people of ordinary skill in the art can be used without departing from the scope and spirit of the exemplary invention.

Figure 2A:
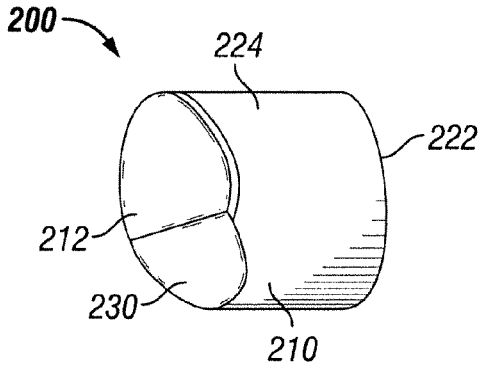
FIG. 2A shows a perspective view of an indexed cutter element in accordance with an exemplary embodiment.
Figure 2B:
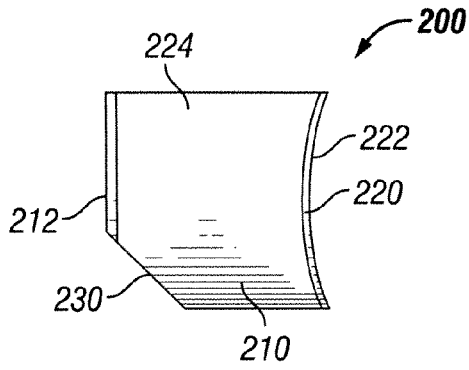
FIG. 2B shows a side view of the indexed cutter element of FIG. 2A in accordance with an exemplary embodiment.

FIG. 2A shows a perspective view of an indexed cutter element 200 in accordance with an exemplary embodiment. FIG. 2B shows a side view of the indexed cutter element 200 of FIG. 2A in accordance with an exemplary embodiment. One or more of the cutter elements 140 (FIG. 1) are indexed cutter elements 200, which are configured to be coupled and self-positioned within the drill bit 100 (FIG. 1). Referring to FIGS. 2A and 2B, the indexed cutter element 200 includes a substrate 210 and a wear resistant layer 220 coupled to the substrate 210. The wear resistant layer 220 is coupled to the substrate 210 according to methods known to people of ordinary skill in the art. As shown in this exemplary embodiment, the indexed cutter element 200 includes a cutting surface 222, a coupling surface 212, and a longitudinal side surface 224 forming the circumferential perimeter of the indexed cutter element 200 and extending from the cutting surface 222 to the coupling surface 212. Additionally, the indexed cutter element 200 has been illustrated as having a substantially circular cylindrical shape. Although the indexed cutter element 200 is shown to have a substantially circular cylindrical shape, the indexed cutter element 200 can be fabricated to have any other geometric shape without departing from the scope and spirit of the exemplary embodiment.

The substrate 210 is fabricated from a composite material that is typically formed from a mixture of a metallic material, such as tungsten carbide, and a binder material, such as cobalt. The metallic material and the binder material are pressed together, thereby liquefying the binder material and cementing the grains of the metallic material together. The binder material is uniformly dispersed throughout the substrate 210. In one exemplary embodiment, a treatment, which can be a high energy treatment, is applied to the substrate 210 to concentrate the binder material according to a desired distribution. Although tungsten carbide can be used as the metallic material, other materials known to persons having ordinary skill in the art can be used as the metallic material without departing from the scope and spirit of the exemplary embodiment. Although cobalt can be used as the binder material, other materials including, but not limited to nickel, iron alloys, and/or combinations of the above, can be used as the binder material without departing from the scope and spirit of the exemplary embodiment. Although one method of forming the substrate 210 has been described, alternative methods for forming the substrate 210 can be used without departing from the scope and spirit of the exemplary embodiment.

The wear resistant layer 220 is concave-shaped and is fabricated from hard cutting elements, such as natural or synthetic diamonds. The indexed cutter elements 200 fabricated from synthetic diamonds are generally known as polycrystalline diamond compact cutters (PDCs). Other materials, including, but not limited to, cubic boron nitride (CBN) and thermally stable polycrystalline diamond (TSP), can be used for the wear resistant layer 220 without departing from the scope and spirit of the exemplary embodiment. Although the wear resistant layer 220 has a concave-shaped surface in this exemplary embodiment, alternative exemplary embodiments can have wear resistant layers 220 having a non-planar surface, a non-cylindrical surface, a planar surface, or a convex-shaped surface without departing from the scope and spirit of the exemplary embodiment.

In this exemplary embodiment, a cutter element index 230 is formed on the indexed cutter element 200 and is formed by indexing at least a portion of the coupling surface 212 and at least a portion of the longitudinal side surface 224 adjacent to the indexed portion of the coupling surface 212. According to this exemplary embodiment, a portion of the coupling surface 212 and a portion of the longitudinal side surface 224 are indexed, thereby making the shape of the cutter element index 230 into an angular cut. Hence, the coupling surface 212 of the indexed cutter element 200 is not substantially planar. Additionally, at least a portion of the longitudinal side surface 224 of the indexed cutter element 200 does not form a substantially uniform perimeter.

Figure 6:
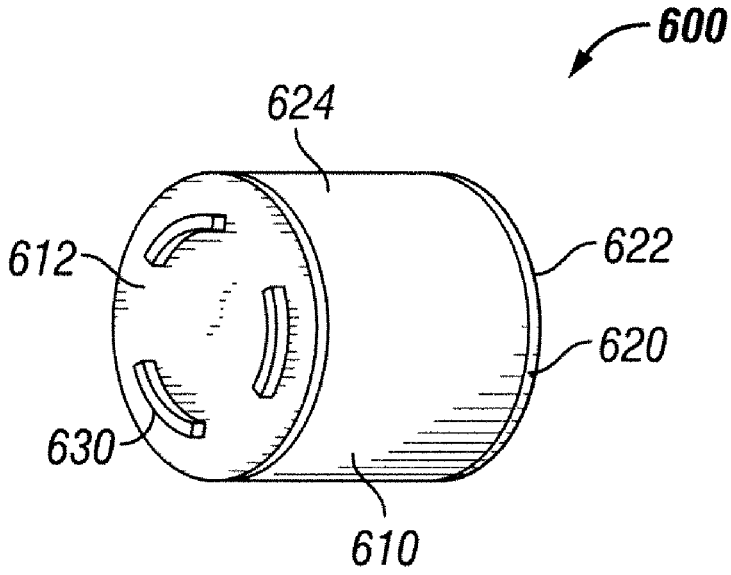
FIG. 6 shows a perspective view of an indexed cutter element in accordance with another exemplary embodiment.

Although the cutter element index 230 is formed as an angular cut extending from a portion of the coupling surface 212 to a portion of the longitudinal side surface 224, other types of cutter element indexes 230 can be formed extending from a portion of the coupling surface 212 to a portion of the longitudinal side surface 224, including, but not limited to, grooves, indentations, and other geometric shapes. Although one cutter element index 230 is formed on the indexed cutter element 200, more than one cutter element index 230 can be formed on at least a portion of the coupling surface 212 of the indexed cutter element 200 without departing from the scope and spirit of the exemplary embodiment. Additionally, in the exemplary embodiments where there are more than one cutter element index 230, the cutter element indexes 230 can be equally spaced apart so that they can be rotated as desired and still make use of the indexing feature. Alternatively, in other exemplary embodiments, the cutter element indexes 230 can be randomly spaced apart. Although this exemplary embodiment includes the cutter element index 230 being formed by indexing at least a portion of the coupling surface 212 and at least a portion of the longitudinal side surface 224, alternate exemplary embodiments can have the cutter element index 230 being formed by indexing only the coupling surface 212, as illustrated in FIG. 6, without departing from the scope and spirit of the exemplary embodiment.

When the indexed cutter elements 200 deform the earth formation, the wear resistant layer 220 of the indexed cutter elements 200 themselves also are slowly worn away. In some of the exemplary embodiments where there are more than one cutter element index 230 formed on the indexed cutter element 200, each indexed cutter element 200 can be unfastened, rotated, and refastened to expose an unworn portion of the wear resistant layer 220 for subsequent drilling operations once the wear resistant layer 220 of the indexed cutter elements 200 wear beyond appreciable levels. These cutter element indexes 230 allow the indexed cutter elements 200 to be coupled to the drill bit 100 (FIG. 1) in a precise manner without relying solely on visual determinations.

Figure 3:
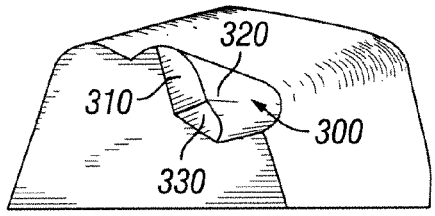
FIG. 3 shows a cross-sectional view of an indexed cutter pocket capable of receiving the indexed cutter element of FIG. 2A in accordance with an exemplary embodiment.

FIG. 3 shows a cross-sectional view of an indexed cutter pocket 300 capable of receiving the indexed cutter element 200 of FIG. 2A in accordance with an exemplary embodiment. One or more indexed cutter pockets 300 are formed within the drill bit 100 (FIG. 1) and is configured to receive the indexed cutter element 200 (FIG. 2A). Referring to FIGS. 2A, 2B, and 3, a cutter pocket index 330 is formed within the indexed cutter pocket 300 and is shaped to correspond and complement the shape of the cutter element index 230 of the cutter element 200.

As shown in this exemplary embodiment, the indexed pocket element 300 includes a mounting surface 310, a longitudinal side mounting surface 320 forming the circumferential perimeter of the indexed cutter pocket 300 and extending away from the mounting surface 310, and a cutter pocket index 330. In this exemplary embodiment, the cutter pocket index 330 is formed within the indexed cutter pocket 300 and is formed by indexing at least a portion of the mounting surface 310 and at least a portion of the longitudinal side mounting surface 320 adjacent to the indexed portion of the mounting surface 310. According to this exemplary embodiment, the shape of the cutter pocket index 330 is an angular cut. Hence, the mounting surface 310 of the indexed cutter pocket 300 is not substantially planar. Additionally, at least a portion of the longitudinal side mounting surface 320 of the indexed cutter pocket 300 does not form a substantially uniform perimeter.

Although the cutter pocket index 330 is formed as an angular cut extending from a portion of the mounting surface 310 to a portion of the longitudinal side mounting surface 320, other types of cutter pocket indexes 330 can be formed extending from a portion of the mounting surface 310 to a portion of the longitudinal side mounting surface 320, including, but not limited to, grooves, indentations, and other geometric shapes. Although one cutter pocket index 330 is formed within the indexed cutter pocket 300, more than one cutter pocket index 330 can be formed on at least a portion of the mounting surface 310 within the indexed cutter pocket 300 without departing from the scope and spirit of the exemplary embodiment. Additionally, the cutter pocket indexes 330 can be equally spaced apart so that the indexed cutter element 200 can be rotated as desired and still make use of the indexing feature present on both the indexed cutter element 200 and the indexed cutter pocket 300. Alternatively, in other exemplary embodiments, the cutter pocket indexes 330 can be randomly spaced apart. Although this exemplary embodiment includes the cutter pocket index 330 being formed by indexing at least a portion of the mounting surface 310 and at least a portion of the longitudinal side mounting surface 320, alternate exemplary embodiments can have the cutter pocket index 330 being formed by indexing only the mounting surface 310 without departing from the scope and spirit of the exemplary embodiment.

Figure 4A:
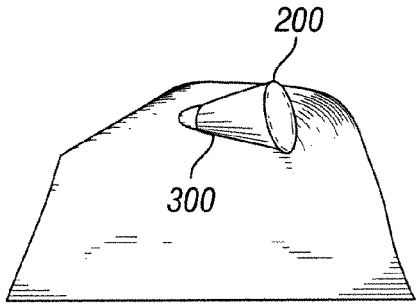
FIG. 4A shows a perspective view of the indexed cutter element of FIG. 2A coupled to the indexed cutter pocket of FIG. 3 in accordance with an exemplary embodiment.
Figure 4B:
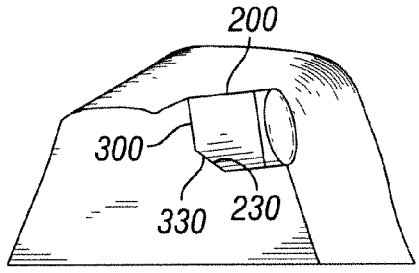
FIG. 4B shows a cross-sectional view of the indexed cutter element of FIG. 2A coupled to the indexed cutter pocket of FIG. 3 in accordance with an exemplary embodiment.

FIG. 4A shows a perspective view of the indexed cutter element 200 of FIG. 2A coupled to the indexed cutter pocket 300 of FIG. 3 in accordance with an exemplary embodiment. FIG. 4B shows a cross-sectional view of the indexed cutter element 200 of FIG. 2A coupled to the indexed cutter pocket 300 of FIG. 3 in accordance with an exemplary embodiment. Referring to FIGS. 4A and 4B, the indexed cutter element 200 is inserted into the indexed cutter pocket 300. A bonding material, such as an adhesive or a braze alloy, can be used to fix the indexed cutter element 200 within the indexed cutter pocket 300. However, alternative methods for coupling the indexed cutter element 200 to the indexed cutter pocket that are known to people of ordinary skill in the art can be used without departing from the scope and spirit of the exemplary embodiment.

In the exemplary embodiment where there is one cutter element index 230 on the indexed cutter element 200 and one cutter pocket index 330 within the indexed cutter pocket 300, the indexed cutter element 200 fits within the indexed cutter pocket 300 in a single orientation and is not configured to be rotatable to an alternative position. However, certain other exemplary embodiments have more than one cutter element index 230 on the indexed cutter element 200 and a corresponding number and complementary shape of cutter pocket indexes 330 within the indexed cutter pocket 300, thereby allowing the indexed cutter element 200 to be rotatable to a precisely fixed alternative orientation within the indexed cutter pocket 300. For example, if there are three cutter element indexes 230 on the indexed cutter element 200 and three cutter pocket indexes 330 within the indexed cutter pocket 300, the indexed cutter element 200 can be fixed within the indexed cutter pocket 300 in three different precise orientations. These orientations are predetermined and are fixed according to the placement of the cutter element indexes 230 on the indexed cutter element 200 and the placement of the cutter pocket indexes 330 within the indexed cutter pocket 300.

Figure 5A:
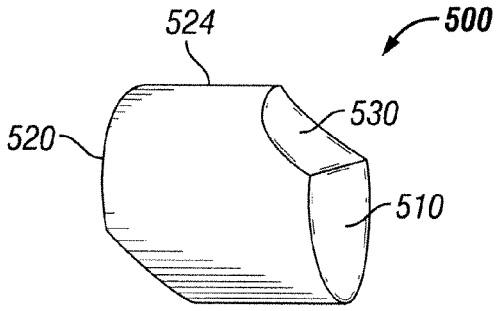
FIG. 5A shows a perspective view of an indexed core plug used to form the indexed cutter pocket of FIG. 3 in accordance with an exemplary embodiment.
Figure 5B:
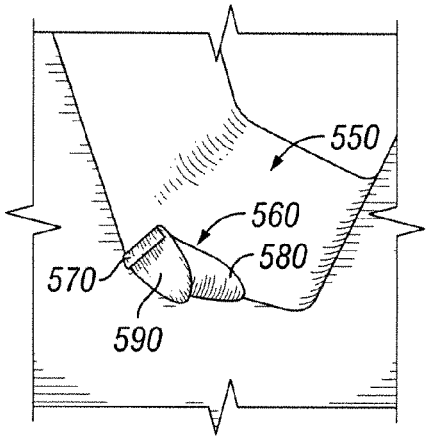
FIG. 5B shows a perspective view of an indexed cutter pocket mold used to form the indexed cutter pocket of FIG. 3 in accordance with an exemplary embodiment.
Figure 5C:
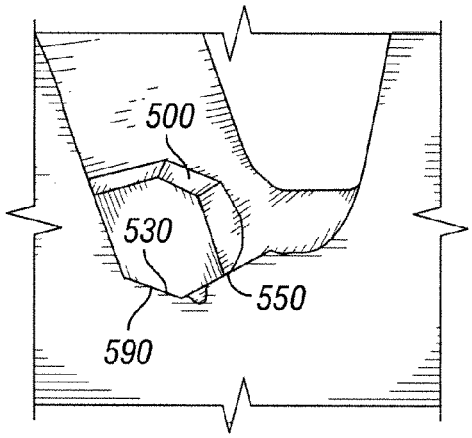
FIG. 5C shows a cross-sectional view of the indexed core plug of FIG. 5A coupled to the indexed cutter pocket mold of FIG. 5B in accordance with an exemplary embodiment.

FIG. 5A shows a perspective view of an indexed core plug 500 used to form the indexed cutter pocket 300 of FIG. 3 in accordance with an exemplary embodiment. FIG. 5B shows a perspective view of an indexed cutter pocket mold 550 used to form the indexed cutter pocket 300 of FIG. 3 in accordance with an exemplary embodiment. FIG. 5C shows a cross-sectional view of the indexed core plug 500 of FIG. 5A coupled to the indexed cutter pocket mold 550 of FIG. 5B in accordance with an exemplary embodiment.

Referring to FIG. 5A, the indexed core plug 500 includes a first lateral surface 510, a second lateral surface 520, and a longitudinal side surface 524 forming the circumferential perimeter of the indexed core plug 500 and extending from the first lateral surface 510 to the second lateral surface 520. In this exemplary embodiment, a core plug index 530 is formed on the indexed core plug 500 and is formed by indexing at least a portion of the first lateral surface 510 and at least a portion of the longitudinal side surface 524 adjacent to the indexed portion of the first lateral surface 510. According to this exemplary embodiment, a portion of the first lateral surface 510 and a portion of the longitudinal side surface 524 are indexed, thereby making the shape of the core plug index 530 into an angular cut. Hence, the first lateral surface 510 of the indexed core plug 500 is not substantially planar. Additionally, at least a portion of the longitudinal side surface 524 of the indexed core plug 500 does not form a substantially uniform perimeter.

Although the core plug index 530 is formed as an angular cut extending from a portion of the first lateral surface 510 to a portion of the longitudinal side surface 524, other types of core plug indexes 530 can be formed, including, but not limited to, grooves, indentations, and other geometric shapes. Although one core plug index 530 is formed on the indexed core plug 500, more than one core plug index 530 can be formed on at least a portion of the first lateral surface 510 of the indexed core plug 500 without departing from the scope and spirit of the exemplary embodiment. Additionally, the core plug indexes 530 can be equally spaced apart so that they can be rotated as desired and still make use of the indexing feature. Alternatively, in other exemplary embodiments, the core indexes 530 can be randomly spaced apart. Although this exemplary embodiment includes the core plug index 530 being formed by indexing at least a portion of the first lateral surface 510 and at least a portion of the longitudinal side surface 524, alternate exemplary embodiments can have the core plug index 530 being formed by indexing only the first lateral surface 510 without departing from the scope and spirit of the exemplary embodiment.

Referring to FIG. 5B, an indexed cutter pocket mold 550 is used to form the indexed cutter pocket 300 (FIG. 3). As shown in this exemplary embodiment, the indexed cutter pocket mold 550 includes an indexed core plug profile 560 that is configured to receive the indexed core plug 500 (FIG. 5A). The indexed core plug profile 560 includes a first lateral surface 570, a longitudinal side surface 580 extending away from the first lateral surface 570, and a pocket mold index 590. In this exemplary embodiment, the pocket mold index 590 is formed by indexing at least a portion of the first lateral surface 570 and at least a portion of the longitudinal side surface 580 adjacent to the indexed portion of the first lateral surface 570. According to this exemplary embodiment, the pocket mold index 590 is shaped into an angular cut. Hence, the first lateral surface 570 of the indexed core plug profile 560 is not substantially planar. Additionally, at least a portion of the longitudinal side surface 580 of the indexed core plug profile 560 does not form a substantially uniform perimeter.

Although the pocket mold index 590 is shaped as an angular cut extending from a portion of the first lateral surface 570 to a portion of the longitudinal side surface 580, other types of pocket mold indexes 590 can be formed, including, but not limited to, grooves, indentations, and other geometric shapes. Although one pocket mold index 590 is formed within the indexed core plug profile 560, more than one pocket mold index 590 can be formed on at least a portion of the first lateral surface 570 within the indexed core plug profile 560 without departing from the scope and spirit of the exemplary embodiment. Additionally, the pocket mold indexes 590 can be equally spaced apart so that once the indexed cutter pocket 300 (FIG. 3) is formed, the indexed cutter element 200 (FIG. 2A) can be rotated as desired and still make use of the indexing feature present on both the indexed cutter element 200 (FIG. 2A) and the resulting indexed cutter pocket 300 (FIG. 3). Alternatively, in other exemplary embodiments, the pocket mold indexes 590 can be randomly spaced apart. Although this exemplary embodiment includes the pocket mold index 590 being formed by indexing at least a portion of the first lateral surface 570 and at least a portion of the longitudinal side surface 580, alternate exemplary embodiments can have the pocket mold index 590 being formed by indexing only the first lateral surface 470 without departing from the scope and spirit of the exemplary embodiment.

Referring to FIG. 5C, the indexed core plug 500 is inserted into the indexed cutter pocket mold 550. In the exemplary embodiment where there is one core plug index 530 on the indexed core plug 500 and one pocket mold index 590 within the indexed cutter pocket mold 550, the indexed core plug 500 fits within the indexed cutter pocket mold 550 in a single orientation and is configured to produce an indexed cutter pocket 300 (FIG. 3) capable of receiving an indexed cutter element 200 (FIG. 2A) in a single precise orientation that is not rotatable. However, certain other exemplary embodiments have more than one core plug index 530 on the indexed core plug 500 and a corresponding number and complementary shape of pocket mold indexes 590 within the indexed cutter pocket mold 550, thereby allowing the formation of an indexed cutter pocket 300 (FIG. 3) capable of receiving an indexed cutter element 200 (FIG. 2A) in precisely fixed alternative orientations within the indexed cutter pocket 300 (FIG. 3). For example, if there are three core plug indexes 530 on the indexed core plug 500 and three pocket mold indexes 590 within the indexed cutter pocket mold 550, the resulting indexed cutter pocket 300 (FIG. 3) allows for the correspondingly shaped indexed cutter element 200 (FIG. 2A) to be fixed within the indexed cutter pocket 300 (FIG. 3) in three different precise orientations that are rotatable. These orientations are predetermined and are fixed according to the placement of the core plug index 530 on the indexed core plug 500 and the placement of the pocket mold index 590 within the indexed cutter pocket mold 550, which results in the fabrication of the indexed cutter pocket 300 (FIG. 3).

Once the indexed core plug 500 is inserted into the indexed cutter pocket mold 550, a suitable material is poured into the mold to form the indexed cutter pockets 300 (FIG. 3) within the drill bit 100 (FIG. 1). The suitable material is allowed to harden. Once the material has hardened, the mold 550 is removed. The indexed core plug 500 also is removed. Although one method of using a mold to form the indexed cutter pockets 300 (FIG. 3) has been described, alternative methods known to people of ordinary skill in the art can be used to form the indexed cutter pockets 300 (FIG. 3) within the drill bit 100 (FIG. 1) without departing from the scope and spirit of the exemplary embodiment.

FIG. 6 shows a perspective view of an indexed cutter element 600 in accordance with another exemplary embodiment. Referring to FIG. 6, the indexed cutter element 600 includes a substrate 610 and a wear resistant layer 620 coupled to the substrate 610. The wear resistant layer 620 is coupled to the substrate 610 according to methods known to people having ordinary skill in the art. As shown in this exemplary embodiment, the indexed cutter element 600 includes a cutting surface 622, a coupling surface 612, and a longitudinal side surface 624 forming the circumferential perimeter of the indexed cutter element 600 and extending from the cutting surface 622 to the coupling surface 612. Additionally, the indexed cutter element 600 has been illustrated as having a substantially circular cylindrical shape. Although the indexed cutter element 600 is shown to have a substantially circular cylindrical shape, the indexed cutter element 600 can be fabricated to have any other geometric shape without departing from the scope and spirit of the exemplary embodiment.

The substrate 610 is fabricated from a composite material that is typically formed from a mixture of a metallic material, such as tungsten carbide, and a binder material, such as cobalt. The metallic material and the binder material are pressed together, thereby liquefying the binder material and cementing the grains of the metallic material together. The binder material is uniformly dispersed throughout the substrate 610. In one exemplary embodiment, a treatment, which can be a high energy treatment, is applied to the substrate 610 to concentrate the binder material according to a desired distribution. Although tungsten carbide can be used as the metallic material, other materials known to persons having ordinary skill in the art can be used as the metallic material without departing from the scope and spirit of the exemplary embodiment. Although cobalt can be used as the binder material, other materials including, but not limited to nickel, iron alloys, and/or combinations of the above, can be used as the binder material without departing from the scope and spirit of the exemplary embodiment. Although one method of forming the substrate 610 has been described, alternative methods for forming the substrate 610 can be used without departing from the scope and spirit of the exemplary embodiment.

The wear resistant layer 620 is fabricated from hard cutting elements, such as natural or synthetic diamonds. The indexed cutter elements 600 fabricated from synthetic diamonds are generally known as PDCs. Other materials, including, but not limited to, CBN and TSP, can be used for the wear resistant layer 620 without departing from the scope and spirit of the exemplary embodiment. The wear resistant layer 620 can have a surface shaped to any geometric shape, including, but not limited to, a concave-shape, a non-planar shape, a non-cylindrical shape, a planar shape, or a convex-shape without departing from the scope and spirit of the exemplary embodiment.

In this exemplary embodiment, three cutter element indexes 630 are formed on the coupling surface 612 of the indexed cutter element 600. According to this exemplary embodiment, the cutter element indexes 630 are protrusions or grooves extending away from the coupling surface 612 in a direction opposite the cutting surface 622; however, alternate exemplary embodiments can have cutter element indexes 630 being indentations formed within the coupling surface 612. Although three cutter element indexes 630 are shown in this exemplary embodiment, greater or fewer cutter element indexes 630, such as two or four cutter element indexes, can be used without departing from the scope and spirit of the exemplary embodiment. Additionally, the cutter element indexes 630 can be equally spaced apart so that the indexed cutter element 600 can be rotated as desired within the indexed cutter pocket 700 (FIG. 7) and still make use of the indexing feature. Alternatively, in other exemplary embodiments, the cutter element indexes 630 can be randomly spaced apart.

When the indexed cutter elements 600 deform the earth formation, the wear resistant layer 620 of the indexed cutter elements 600 themselves also are slowly worn away. According to an exemplary embodiment, each indexed cutter element 600 can be unfastened, rotated, and refastened to expose an unworn portion of the wear resistant layer 620 for subsequent drilling operations once the wear resistant layer 620 of the indexed cutter elements 600 wear beyond appreciable levels. These cutter element indexes 630 allow the indexed cutter elements 600 to be coupled to the drill bit 100 (FIG. 1) in a precise manner without relying solely on visual determinations. According to the exemplary embodiment shown in FIG. 6, the indexed cutter element can be rotated in 120 degree increments. Depending upon the number of cutter element indexes 630 formed on the indexed cutter element 600, the incremental angle at which the indexed cutter element 600 rotates can range from greater than zero degrees to 180 degrees. For example, in the exemplary embodiment where there are two equally spaced cutter element indexes 630 formed on the indexed cutter element 600, the incremental angle at which the indexed cutter element 600 rotates is 180 degrees. In another exemplary embodiment, the incremental angle at which the indexed cutter element 600 rotates is 90 degrees when there are four equally spaced cutter element indexes 630 formed on the indexed cutter element 600.

Figure 7:
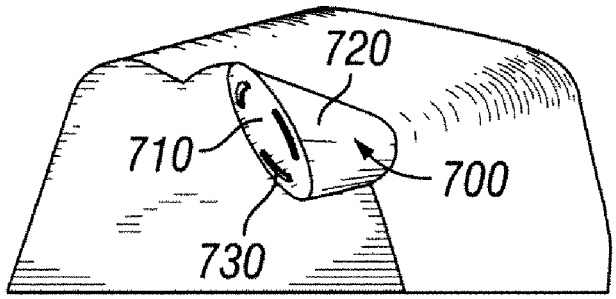
FIG. 7 shows a perspective view of an indexed cutter pocket capable of receiving the indexed cutter element of FIG. 6 in accordance with an exemplary embodiment.

FIG. 7 shows a perspective view of an indexed cutter pocket 700 capable of receiving the indexed cutter element 600 of FIG. 5 in accordance with an exemplary embodiment. Referring to FIG. 7, a cutter pocket index 730 is formed within the cutter pocket 700 and is shaped to correspond to the shape of the cutter element index 630 (FIG. 6) of the indexed cutter element 600 (FIG. 6). As shown in this exemplary embodiment, the indexed pocket element 700 includes a mounting surface 710, a longitudinal side mounting surface 720 forming the circumferential perimeter of the indexed cutter pocket 700 and extending away from the mounting surface 710, and a cutter pocket index 730. In this exemplary embodiment, three cutter pocket indexes 730 are formed within the indexed cutter pocket 700 on the mounting surface 710. Since the cutter element indexes 630 (FIG. 6) of cutter element 600 (FIG. 6) are protrusions, the cutter pocket indexes 730 are corresponding indentations. Alternatively, if the cutter element indexes 630 (FIG. 6) of cutter element 600 (FIG. 6) are indentations, the cutter pocket indexes 730 are corresponding protrusions. Although three cutter pocket indexes 730 are formed within the indexed cutter pocket 700, greater or fewer cutter pocket indexes 730 can be formed within the indexed cutter pocket 700 without departing from the scope and spirit of the exemplary embodiment. Additionally, the cutter pocket indexes 730 can be equally spaced apart so that the indexed cutter element 600 (FIG. 6) can be rotated as desired and still make use of the indexing feature present on both the indexed cutter element 600 (FIG. 6) and the indexed cutter pocket 700. Alternatively, in other exemplary embodiments, the cutter pocket indexes 730 can be randomly spaced apart.

Exemplary embodiments of the present invention allow usage of one or more indexed cutter elements coupled to the drill bit. Additionally, exemplary embodiments allow for precise orientation of one or more indexed cutter elements within the indexed cutter pockets, including, but not limited to, cutter elements having a non-planar interface, cutter elements having a specific geometry, and cutters having a non-planar diamond table face. Further, exemplary embodiments allow for one or more indexed cutter elements having variations in material property to be used in a drill bit and have a precise orientation.

Although each exemplary embodiment has been described in detailed, it is to be construed that any features and modifications that is applicable to one embodiment is also applicable to the other embodiments.

Although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

We claim:

1. A cutting element, comprising:

a substrate comprising a coupling surface at one end of the substrate, the coupling surface configured to be coupled within a cutter pocket; and a plurality of cutter indexes formed on at least a portion of the coupling surface, wherein each cutter index is positioned about the central axis of the substrate and extends less than entirely about the central axis, and wherein the plurality of cutter indexes are substantially equally spaced apart circumferentially about the central axis of the substrate, the coupling surface being precisely positionable within the cutter pocket in more than one position, wherein the coupling surface is non-planar.

2. The cutting element of claim 1, further comprising a wear resistant layer having an exposed cutting surface, wherein the wear resistant layer is coupled to the substrate.

3. The cutting element of claim 1, wherein the plurality of cutter indexes comprise at least one of a protrusion, an indentation, or a combination of a protrusion and an indentation.

4. The cutting element of claim 1, wherein the cutting element further comprises a longitudinal side surface forming the circumferential perimeter of the cutter element and extending from the exposed cutting surface to the coupling surface, and wherein at least one of the plurality of cutter indexes is formed along at least a portion of the longitudinal side surface.

5. The cutting element of claim 4, wherein at least a portion of the longitudinal side surface does not form a substantially uniform perimeter.

6. The cutting element of claim 4, wherein the plurality of cutter indexes are angle-cut extending from the coupling surface to the longitudinal side surface.

7. The cutting element of claim 1, wherein at least one cutter index has the same shape and size as at least one other cutter index.

8. A downhole tool, comprising:

at least one indexed cutter element comprising a coupling surface at one end of the indexed cutter element;

at least one indexed cutter pocket configured to receive the at least one indexed cutter element and couple with the coupling surface;

a plurality of cutter indexes formed on at least a portion of the coupling surface; and a plurality of pocket indexes formed on at least a mounting surface of the indexed cutter pocket, wherein each pocket index is configured to be coupled to any one of at least two cutter indexes formed on at least a portion of the coupling surface, wherein each cutter index is positioned about the central axis of the indexed cutter element and extends less than entirely about the central axis, wherein the plurality of cutter indexes are substantially equally spaced apart circumferentially about the central axis of the indexed cutter element, the coupling surface being precisely positionable within a corresponding indexed cutter pocket in more than one position, and wherein the coupling surface is non-planar.

9. The downhole tool of claim 8, wherein the plurality of pocket indexes comprise at least one of a protrusion, an indentation, or a combination of a protrusion and an indentation.

10. The downhole tool of claim 8, wherein the indexed cutter pocket further comprises a longitudinal side surface forming the circumferential perimeter of the indexed cutter pocket and extending from the mounting surface, and wherein at least one of the plurality of pocket indexes is formed along at least a portion of the longitudinal side surface.

11. The downhole tool of claim 10, wherein at least a portion of the longitudinal side surface does not form a substantially uniform perimeter.

12. The downhole tool of claim 10, wherein the plurality of pocket indexes are angle-cut extending from the mounting surface to the longitudinal side surface.

13. The downhole tool of claim 8, wherein at least one cutter index has the same shape and size as at least one other cutter index.

14. A cutting element, comprising:

a substrate comprising a coupling surface at one end of the substrate, the coupling surface configured to be coupled within a cutter pocket;

a wear resistant layer coupled to an opposing end of the substrate opposite from the coupling surface;

a sidewall extending from the perimeter of the substrate to the perimeter of the wear resistant layer; and a plurality of cutter indexes formed on at least a portion of the coupling surface, wherein each cutter index is positioned about the central axis of the substrate and extends less than entirely about the central axis, wherein the plurality of cutter indexes are substantially equally spaced apart circumferentially about the central axis of the substrate, the coupling surface being precisely positionable within the cutter pocket in more than one position, and wherein the plurality of cutter indexes are formed only on the coupling surface.

15. The cutting element of claim 14, wherein the plurality of cutter indexes comprise at least one of a protrusion, an indentation, or a combination of a protrusion and an indentation.

16. The cutting element of claim 14, wherein at least one cutter index has the same shape and size as at least one other cutter index.

17. A cutting element, comprising:

a substrate comprising a coupling surface at one end of the substrate, the coupling surface configured to be coupled within a cutter pocket; and a plurality of cutter indexes formed on at least a portion of the coupling surface, wherein each cutter index is positioned about the central axis of the substrate and extends less than entirely about the central axis, and wherein the plurality of cutter indexes are substantially equally spaced apart circumferentially about the central axis of the substrate, the coupling surface being precisely positionable within the cutter pocket in more than one position, wherein the plurality of cutter indexes are formed only on the coupling surface.

18. The cutting element of claim 17, wherein the plurality of cutter indexes comprise at least one of a protrusion, an indentation, or a combination of a protrusion and an indentation.

19. A downhole tool, comprising:

at least one indexed cutter element comprising a coupling surface at one end of the indexed cutter element;

at least one indexed cutter pocket configured to receive the at least one indexed cutter element and couple with the coupling surface;

a plurality of cutter indexes formed on at least a portion of the coupling surface; and a plurality of pocket indexes formed on at least a mounting surface of the indexed cutter pocket, wherein each pocket index is configured to be coupled to any one of at least two cutter indexes formed on at least a portion of the coupling surface, wherein each cutter index is positioned about the central axis of the indexed cutter element and extends less than entirely about the central axis, wherein the plurality of cutter indexes are substantially equally spaced apart circumferentially about the central axis of the indexed cutter element, the coupling surface being precisely positionable within a corresponding indexed cutter pocket in more than one position, and wherein the plurality of pocket indexes are formed only on the mounting surface.

20. The downhole tool of claim 19, wherein the plurality of pocket indexes comprise at least one of a protrusion, an indentation, or a combination of a protrusion and an indentation.

21. A downhole tool, comprising:

at least one indexed cutter element comprising a coupling surface at one end of the indexed cutter element;

at least one indexed cutter pocket configured to receive the at least one indexed cutter element and couple with the coupling surface;

a plurality of cutter indexes formed on at least a portion of the coupling surface; and a plurality of pocket indexes formed on at least a mounting surface of the indexed cutter pocket, wherein each pocket index is configured to be coupled to any one of at least two cutter indexes formed on at least a portion of the coupling surface, wherein each cutter index is positioned about the central axis of the indexed cutter element and extends less than entirely about the central axis, wherein the plurality of cutter indexes are substantially equally spaced apart circumferentially about the central axis of the indexed cutter element, the coupling surface being precisely positionable within a corresponding indexed cutter pocket in more than one position, and wherein the mounting surface is non-planar.

22. The downhole tool of claim 21, wherein the plurality of pocket indexes comprise at least one of a protrusion, an indentation, or a combination of a protrusion and an indentation.

* * * * *